US010138702B2

(12) United States Patent
Nguyen et al.

(10) Patent No.: US 10,138,702 B2
(45) Date of Patent: Nov. 27, 2018

(54) MINERAL EXTRACTION WELL SEAL

(71) Applicant: Cameron International Corporation, Houston, TX (US)

(72) Inventors: Dennis P. Nguyen, Pearland, TX (US); Delbert E. Vanderford, Cypress, TX (US)

(73) Assignee: Cameron International Corporation, Houston, TX (US)

( * ) Notice: Subject to any disclaimer, the term of this patent is extended or adjusted under 35 U.S.C. 154(b) by 94 days.

(21) Appl. No.: 15/263,145

(22) Filed: Sep. 12, 2016

(65) Prior Publication Data

US 2018/0073326 A1 Mar. 15, 2018

(51) Int. Cl.

| | |
|---|---|
| ***E21B 23/01*** | (2006.01) |
| ***E21B 23/02*** | (2006.01) |
| ***E21B 33/04*** | (2006.01) |
| ***E21B 33/128*** | (2006.01) |
| ***E21B 23/00*** | (2006.01) |
| ***E21B 33/06*** | (2006.01) |
| ***E21B 23/04*** | (2006.01) |
| ***E21B 33/03*** | (2006.01) |

(Continued)

(52) U.S. Cl.

CPC ..... *E21B 33/1285* (2013.01); *E21B 23/00* (2013.01); *E21B 23/04* (2013.01); *E21B 33/03* (2013.01); *E21B 33/06* (2013.01); *E21B 33/068* (2013.01); *E21B 2033/005* (2013.01)

(58) Field of Classification Search

CPC ..... E21B 23/01; E21B 23/02; E21B 23/04; E21B 33/04; E21B 33/1295; E21B 33/1285

See application file for complete search history.

(56) References Cited

U.S. PATENT DOCUMENTS 4,407,530 A * 10/1983 Fowler ..... E21B 33/04 285/123.12
6,921,081 B2 * 7/2005 Wobben ..... F16J 15/3208 277/510

(Continued)

FOREIGN PATENT DOCUMENTS

| | | |
|---|---|---|
| WO | 2012060909 A1 | 5/2012 |
| WO | 2014038956 A1 | 3/2014 |
| WO | 2016018605 A2 | 2/2016 |

OTHER PUBLICATIONS

PCT Search Report and Written Opinion for PCT/US2017/051011, dated Dec. 15, 2017; 14 pgs.

*Primary Examiner* — Cathleen R Hutchins
(74) *Attorney, Agent, or Firm* — Fletcher Yoder, P.C.

(57) ABSTRACT

A system includes a seal assembly that includes an annular body, an interior sealing assembly coupled to an interior surface of the body, and an exterior sealing assembly coupled to an exterior surface of the body. The interior sealing assembly is actuated by a first piston and configured to form a seal between the body and a first fixed substantially tubular member disposed radially interior of the body. The exterior sealing assembly is actuated by a second piston, and configured to form a seal between the body and a second fixed substantially tubular member disposed about the seal assembly. The seal assembly is configured to be run through a blowout preventer (BOP) stack and installed between the first and second fixed substantially tubular members to seal a mineral extraction well.

17 Claims, 14 Drawing Sheets

(51) Int. Cl.
*E21B 33/068* (2006.01)
*E21B 33/00* (2006.01)

(56) References Cited

U.S. PATENT DOCUMENTS

| | | | | |
|---|---|---|---|---|
| 7,909,110 | B2 * | 3/2011 | Sharma | E21B 23/02 166/180 |
| 2004/0251031 | A1 | 12/2004 | Reimert | |
| 2016/0010404 | A1 | 1/2016 | Nguyen et al. | |

* cited by examiner

MINERAL EXTRACTION WELL SEAL

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Oil and natural gas have a profound effect on modern economies and societies. In order to meet the demand for such natural resources, numerous companies invest significant amounts of time and money in searching for, accessing, and extracting oil, natural gas, and other subterranean resources. Particularly, once a desired resource is discovered below the surface of the earth, drilling and production systems are often employed to access and extract the resource. These systems can be located onshore or offshore depending on the location of a desired resource. Such systems generally include a wellhead assembly through which the resource is extracted. These wellhead assemblies generally include a wide variety of components and/or conduits, such as blowout preventers (BOPs), as well as various control lines, casings, valves, and the like, that control drilling and/or extraction operations.

It may be beneficial to have the capability to seal the well quickly and on short notice (e.g., in the event of an emergency). Typically, the BOP is removed and a tool is used to install a seal in the well. It would be beneficial to reduce the complexity and time to seal a well in the event of an emergency.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Embodiments of the presently disclosed techniques include systems and methods for sealing a well on short notice (e.g., in the event of an emergency). As explained in greater detail below, the disclosed embodiments include a seal assembly and corresponding tool configured to set, load, and hold down the seal assembly in a single trip. Furthermore, some embodiments of the disclosed seal assembly and tool may be run through the BOP. Thus, the well may be sealed without removing the BOP.

Figure 1:
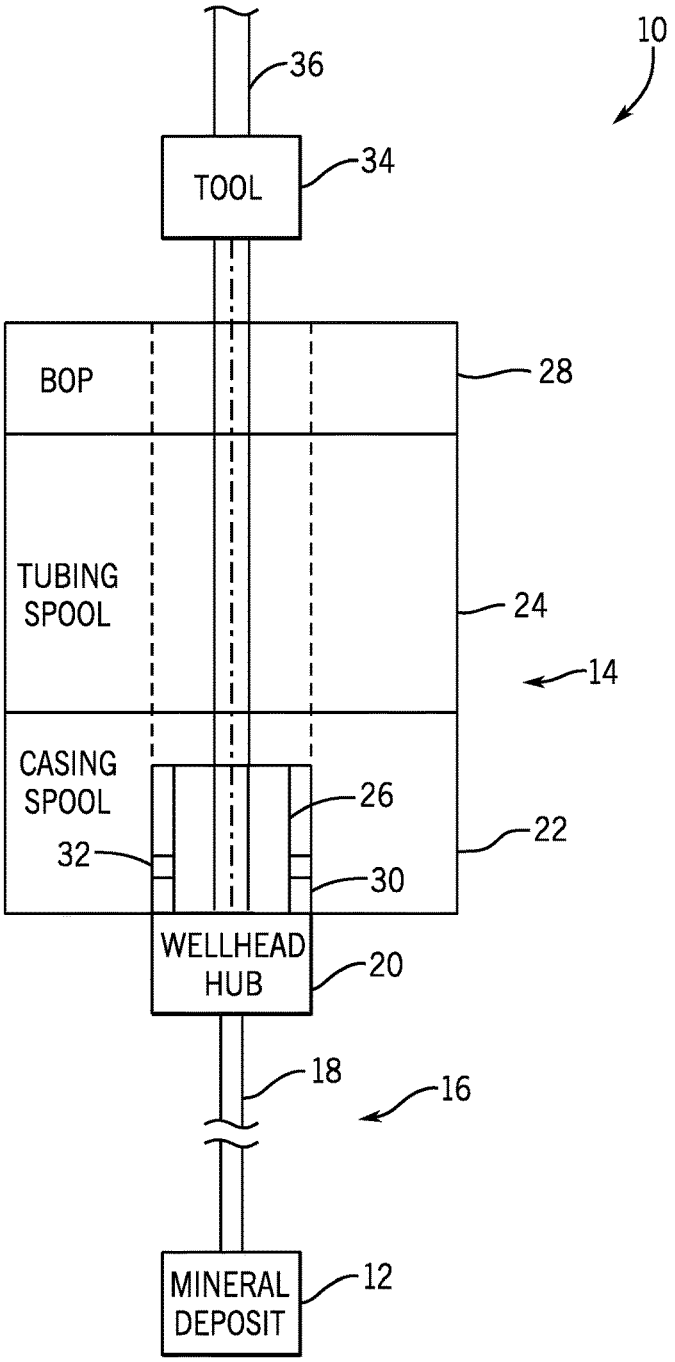
FIG. 1 is a schematic of an embodiment of a mineral extraction system.

FIG. 1 is a schematic of an exemplary mineral extraction system 10 configured to extract various natural resources, including hydrocarbons (e.g., oil and/or natural gas), from a mineral deposit 12. Depending upon where the natural resource is located, the mineral extraction system 10 may be land-based (e.g., a surface system) or subsea (e.g., a subsea system). The illustrated system 10 includes a wellhead assembly 14 coupled to the mineral deposit 12 or reservoir via a well 16. Specifically, a well bore 18 extends from the reservoir 12 to a wellhead hub 20 located at or near the surface.

The illustrated wellhead hub 20, which may be a large diameter hub, acts as an early junction between the well 16 and the equipment located above the well. The wellhead hub 20 may include a complementary connector, such as a collet connector, to facilitate connections with the surface equipment. The wellhead hub 20 may be configured to support various strings of casing or tubing that extend into the wellbore 18, and in some cases extending down to the mineral deposit 12.

The wellhead 14 generally includes a series of devices and components that control and regulate activities and conditions associated with the well 16. For example, the wellhead 14 may provide for routing the flow of produced minerals from the mineral deposit 12 and the well bore 18, provide for regulating pressure in the well 16, and provide for the injection of chemicals into the well bore 18 (downhole). In the illustrated embodiment, the wellhead 14 includes a casing spool 22 (e.g., tubular), a tubing spool 24 (e.g., tubular), a hanger 26 (e.g., a tubing hanger or a casing hanger), and a blowout preventer (BOP) 28.

In operation, the wellhead 14 enables completion and workover procedures, such as tool insertion into the well 16 and installation of various components (e.g., hangers, shoulders, etc.). Further, minerals extracted from the well 16 (e.g., oil and natural gas) may be regulated and routed via the wellhead 14. For example, the blowout preventer (BOP) 28 may include a variety of valves, fittings, and controls to prevent oil, gas, or other fluid from exiting the well 16 in the event of an unintentional release of pressure or an overpressure condition.

As illustrated, the casing spool 22 defines a bore 30 that enables fluid communication between the wellhead 14 and the well 16. Thus, the casing spool bore 30 may provide access to the well bore 18 for various completion and workover procedures, such as emplacing tools or components within the casing spool 22. To emplace the components, a shoulder 32 provides a temporary or permanent landing surface that can support pieces of equipment. For example, the illustrated embodiment of the extraction system 10 includes a tool 34 suspended from a drill string 36. In certain embodiments, the tool 34 may include running tools (e.g., hanger running tools, shoulder running tools, slip tools, etc.) that are lowered (e.g., run) to the well 16, the wellhead 14, and the like.

In some instances (e.g., emergency situations), it may be desirable to seal the well 16 quickly. Though such instances are rare, they may be unpredictable. Accordingly, it may be beneficial to have the capability to seal the well 16 quickly on short notice. Typically, the BOP is removed and a seal is installed in the well using one or more tools 34. Installing the seal typically involves more than one trip for the tool 34. Removing the BOP and making multiple trips with the tool 34 may extend the time to seal the well 16. The disclosed techniques include systems and methods for running a seal assembly through the BOP 28 and installing the seal assembly with a single trip of the tool 34.

Figure 2:
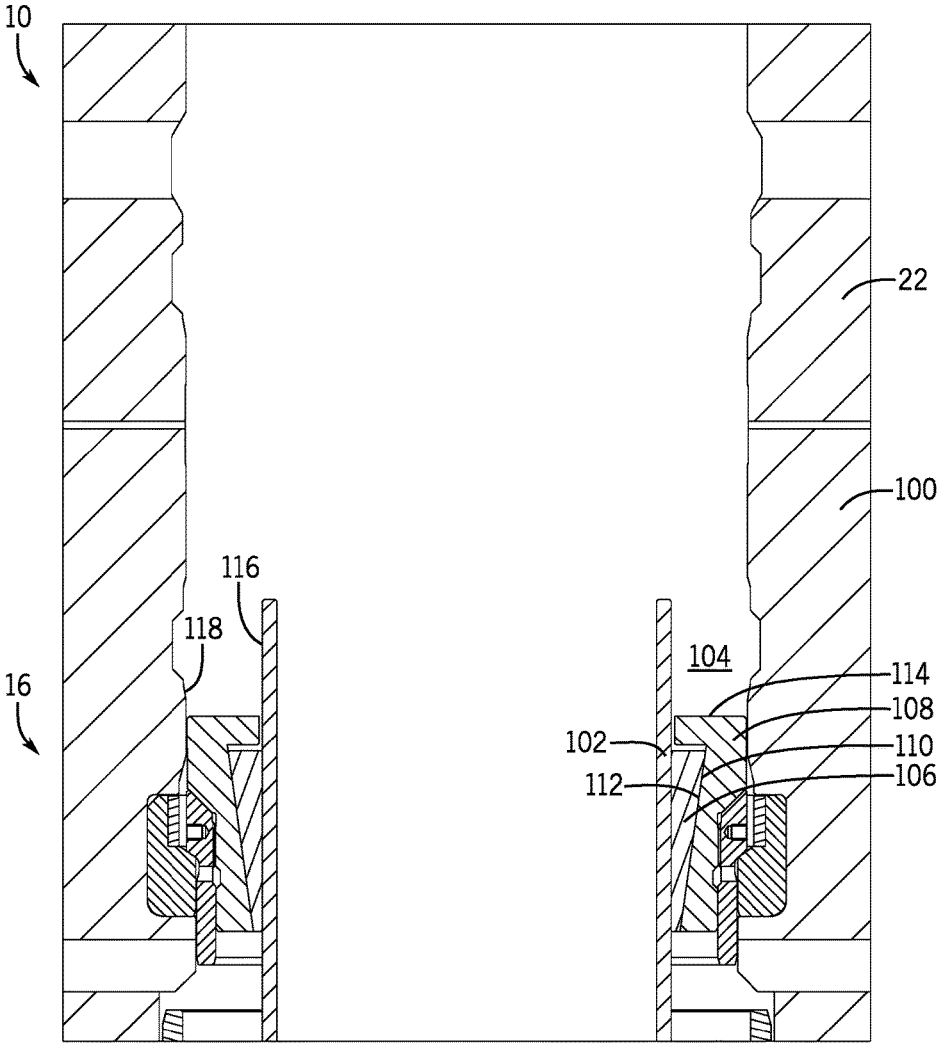
FIG. 2 is a side, section view of one embodiment of a well.

FIG. 2 is a side, section view of a well 16 to be sealed. In the illustrated embodiment, a fixed housing 100 (e.g., annular housing or tubular housing) extends downward from the casing spool 22. However the housing 100 may be part of the wellhead assembly 14, part of the wellhead hub 20, or part of the well bore 18, depending upon where the well 16 is to be sealed. For example, a hanger 26, shoulder 32, or other component may become stuck in the well 16, dictating where the well 16 is sealed. Accordingly, it should be understood that the disclosed techniques may be used to seal the well 16 at various locations throughout the well 16 (e.g., the well bore 18, wellhead hub 20, the casing spool 22, the tubing spool 24, etc.) and that the embodiment shown in FIG. 2 is merely exemplary. A fixed tubular casing 102 (e.g., annular casing) extends through the housing and down the well bore 18. An annular gap 104 may be disposed between the casing 102 and the housing 100. Various components may be disposed in the gap 104 to support the casing 102, to join sections of casing 102 or sections of housing 100, to control fluid flow, to support other components, and the like. In the embodiment shown in FIG. 2, the casing 102 extends axially part of the way up through the housing 100. The end of the casing 102 may be the end of a section of installed casing 102, or the casing may have been cut in preparation for sealing. A slip 106 (e.g., annular slip) is disposed about the casing 102. The slip 106 is tapered such that an inside diameter of the slip 106 is substantially constant along a height of the slip, but an outside diameter is larger at a top end of the slip than at a bottom end of the slip 106. Disposed about the slip 106 is a slip bowl 108 (e.g., annular slip bowl). The slip bowl 108 has a tapered annular interior surface 110 that interfaces with a tapered annular exterior surface 112 (e.g., conical surface) of the slip 106 to hold the slip 106 in place. The slip bowl 108 also has a top surface 114, on which various components may land. In order to seal the well 16, a seal may be formed between an exterior surface 116 of the casing 102 and an interior surface 118 of the housing 100.

Figure 3:
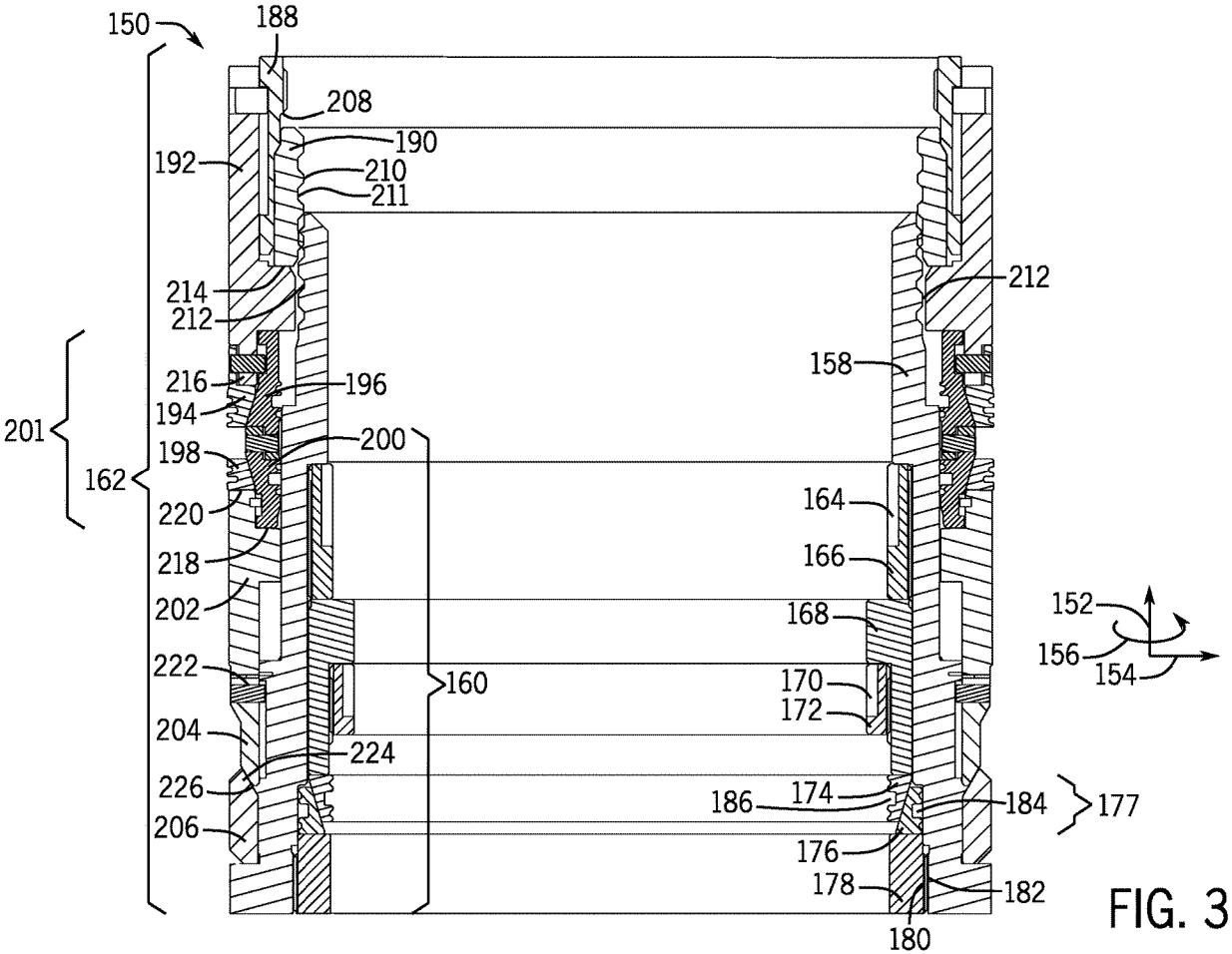
FIG. 3 is a side, section view of a seal assembly.

FIG. 3 is a side, section view of a seal assembly 150. For clarity, a coordinate system is shown in FIG. 3 having an axial direction 152, a radial direction 154, and a circumferential direction 156. Reference is made to these directions below in describing the various disclosed embodiments. The seal assembly has a substantially tubular body 158. An inner sealing subassembly 160 is coupled to the interior (in the radial direction 154) of the body 158 and configured to form a seal with the exterior surface 116 of the casing 102 (see FIG. 2). An outer sealing subassembly 162 is coupled to the exterior (in the radial direction 154) of the body 158 and configured to form a seal with the interior surface 118 of the housing 100 (see FIG. 2).

From top to bottom in the axial direction 152, the inner sealing subassembly 160 includes an upper preload ring 164, a hold down ring 166, a push ring 168, a lower preload ring 170, a casing lockdown ring 172, a casing seal 174 (e.g., annular seal), a body seal 176 (e.g., annular seal), and a threaded ring 178. The threaded ring 178 has an exterior threaded surface 180 that engages with an interior threaded surface 182 of the body 158. The body seal 176 rests on top of the threaded ring 178. The exterior surface of the body seal 176 has an O-ring or other annular seal 184 that forms a seal with the body 158. The interior surface of the body seal 176 has an inward taper (e.g., tapered annular surface or conical surface). The exterior surface of the casing seal 174 has an O-ring or other annular seal 186 that forms a seal with the casing. The casing seal 174 has an exterior surface with an inward taper (e.g., tapered annular surface or conical surface) corresponding to the interior surface of the body seal 176. The casing seal 174 and the body seal 176 may be collectively referred to as the interior sealing assembly 177. The tapered surfaces interface with one another such that as the casing seal 174 moves upward in the axial direction 152, the casing seal 174 moves radially outward (direction 154), and as the body seal 174 moves downward in the axial direction 152, the casing seal 174 moves radially inward (direction 154). This is shown and described with more detail with regard to FIGS. 14 and 15. The push ring 168 contacts the casing seal 174 such that the push ring 168 may apply a downward force in the axial direction 152 on the casing seal 174. The push ring 168 may also release, allowing the casing seal 174 to move upward in the axial direction 152. The casing lockdown ring 172 has an exterior threaded surface that interfaces with an interior threaded surface of the push ring 168. The lower preload ring 170 and the casing lockdown ring 172 may support the push ring 168 by preventing or allowing movement of the push ring 168 downward in the axial direction 152. Correspondingly, the upper preload ring 164 and the hold down ring 166 push the push ring 168 downward in the axial direction 152, or allow movement of the push ring 168 upward in the axial direction 152. The hold down ring 166 has an exterior threaded surface that interfaces with an interior threaded surface of the body 158.

The outer sealing subassembly 162 includes, from top to bottom in the axial direction 152, a top push ring 188, a top lock ring 190, a load ring 192, a top outer seal 194 (e.g., annular seal), a top inner seal 196 (e.g., annular seal), a bottom outer seal 198 (e.g., annular seal), a bottom inner seal 200 (e.g., annular seal), a bottom retainer ring 202, a bottom push ring 204, and a bottom lock ring 206. The top push ring 188 is annular in shape and is disposed about the top lock ring 190. The top push ring 188 has tapered lips 208 (e.g., tapered conical surfaces) that interface with the top lock ring 190 such that when the top push ring 188 moves downward in the axial direction 152, the top push ring 188 pushes the top lock ring 190 radially inward 154. Correspondingly, when the top push ring 188 moves upward in the axial direction 152, the top push ring 188 releases the top lock ring 190, allowing the top lock ring 190 to expand radially outward 154. The top lock ring 190 is also annular in shape and includes teeth 210 (e.g., annular teeth or protrusions and recessed) on an interior surface 211 of the top lock ring 190 that interface with corresponding teeth 212 on the body 158. The load ring 192 is annular in shape and is disposed about the top lock ring 190. The load ring 192 includes a lip (e.g., annular surface 214), upon which the top lock ring 190 rests. The load ring 192 also includes a protrusion 216 (e.g., annular protrusion) at an axial end of the load ring 192, which interfaces with the top outer seal 194. The top inner seal 196 is annular in shape and disposed about the body 158. The top outer seal 194 is annular in shape and disposed about the top inner seal 196. The top outer seal 196 has an interior surface that tapers outward and interfaces with an outward tapering exterior surface of the top inner seal 196, such that as the top outer seal 194 moves axially 152 downward, the top outer seal 194 expands radially 154 outward. As the top outer seal 194 moves axially 152 upward, the top outer seal 194 contracts radially 154 inward. The exterior sealing assembly 201 is shown and described in more detail with regard to FIGS. 10 and 11.

The bottom outer seal 198 and bottom inner seal 200 interface with one another in a similar fashion to the top outer seal 194 and the top inner seal 196, but upside down. For example, the bottom inner seal 200 is annular in shape and disposed about the body 158. The bottom outer seal 198 is annular in shape and disposed about the bottom inner seal 200. The bottom outer seal 198 has an interior surface (e.g., tapered conical surface) that tapers inward and interfaces with an inward tapering exterior surface (e.g., tapered conical surface) of the bottom inner seal 200, such that as the bottom outer seal 198 moves axially 152 upward, the bottom outer seal 198 expands radially 154 outward. As the bottom outer seal 198 moves axially 152 downward, the bottom outer seal 198 contracts radially 154 inward. The top outer seal 194, the top inner seal 196, the bottom outer seal 198, and the bottom inner seal 200 may be collectively referred to as the exterior sealing assembly 201, which is shown and described in more detail with regard to FIGS. 10 and 11.

The bottom retainer ring 202 is annular in shape and disposed about the body 158. The bottom retainer ring 202 includes a lip (first annular surface 218) upon which the bottom inner seal 200 rests. The top surface (e.g., second annular surface 220) of the retainer ring 202 sits above the first annular surface 218 in the axial direction 152 and supports the bottom outer seal 198. The bottom retainer ring 202 transfers force to the bottom push ring 204 via a bottom surface 222 (e.g., third annular surface) of the bottom push ring 204. The bottom push ring 204 is annular in shape and has an inward tapered exterior surface 224 at an axial end (e.g., in the axial direction 152). The inward tapered exterior surface 224 (e.g., tapered conical surface) of the bottom push ring 204 interfaces with an inward tapered interior surface 226 (e.g., tapered conical surface) of the annular bottom lock ring 206 such that when the bottom push ring 204 moves toward the bottom lock ring 206 in the axial direction 152, the bottom lock ring 206 expands radially 154 outward into an annular recess. Correspondingly, when the bottom push ring 204 moves away from the bottom lock ring 206 in the axial direction 152, the bottom lock ring 206 contracts radially 154 inward out of the annular groove. This is shown and described in more detail with regard to FIGS. 8 and 9.

Figure 4:
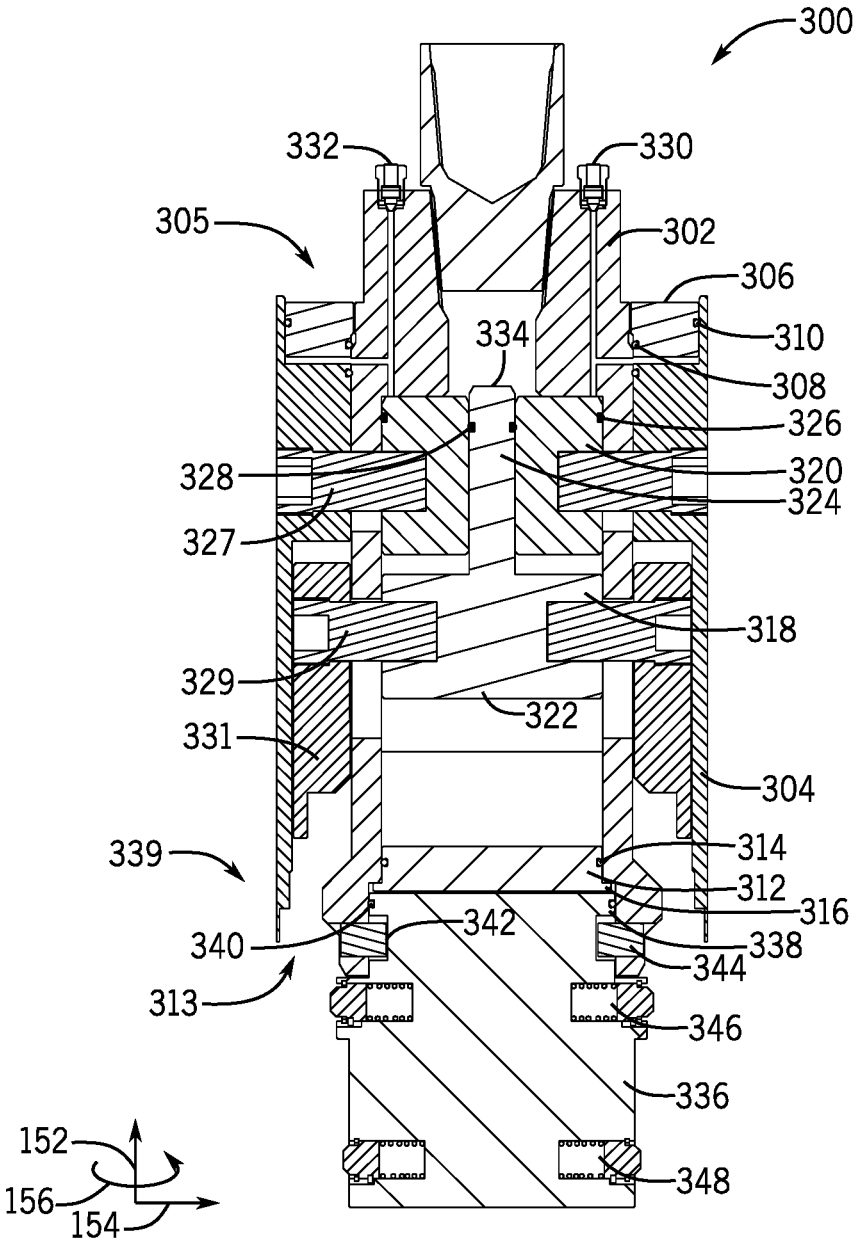
FIG. 4 is a side, section view of an embodiment of a running tool assembly used to install the seal assembly of FIG. 3.

FIG. 4 is a side, section view of a running tool assembly 300 used to install the seal assembly 150 shown in FIG. 3. The running tool assembly 300 includes a body 302 (e.g., annular body), and a sleeve 304 disposed about the body 302. An annular upper retainer seal ring 306 is disposed radially 154 between the body 302 and the sleeve 304 at an axial end 305 of the body 302. The upper retainer seal ring 306 includes an inner O-ring 308 on a radially interior surface of the upper retainer seal ring 306, which forms a seal between the upper retainer seal ring 306 and the body 302. The upper retainer seal ring 306 also includes an outer O-ring 310 on a radially 154 exterior surface of the upper retainer seal ring 306, which forms a seal between the upper retainer seal ring 306 and the sleeve 304. Similarly, the running tool assembly 300 includes a lower retainer seal ring 312 at an axial end 313 of the body 302, opposite the upper retainer seal ring 306. The lower retainer seal ring 312 is disposed radially 154 inside of the body 302. The lower retainer seal ring 312 includes an O-ring 314 in a radially 154 exterior surface of the lower retainer seal ring 312. In the illustrated embodiment, the lower retainer seal ring 312 also includes a flange 316 at an axial 152 end of the lower retainer seal ring 312, which may interface with the body 302 to prevent axial 152 movement of the lower retainer seal ring 312 relative to the body 302.

A lower piston 318 (e.g., cylindrical piston) and an upper piston 320 (e.g., annular piston) may be disposed within the body 302. The lower piston 318 may have a cylindrical portion 322 having a diameter that fits within the body 302. In the illustrated embodiment, the lower piston 318 also includes a cylindrical protrusion 324, which may have a diameter smaller than that of the cylindrical portion 322 and may extend axially 152 outward from the cylindrical portion 322. As shown, the upper piston is disposed about the protrusion 324 of the lower piston 318 and axially 152 adjacent to the cylindrical portion 322 of the lower piston 318. The upper piston 320 may include one or more O-rings 326 on a radially exterior surface (e.g., annular surface) of the upper piston 320, which form a seal between the upper piston 320 and the body 302. Similarly, the lower piston 318 may include an O-ring 328 on a radially exterior surface (e.g., annular surface) of the protrusion 324 of the lower piston 318, forming a seal between the protrusion 324 of the lower piston 318 and the upper piston 320.

One or more upper load pins 327 may extend radially through the sleeve 304 and into the upper piston 320, coupling the sleeve 304 to the upper piston 320. As the upper piston 320 moves back and forth in the axial direction 152, the sleeve 304 moves axially with the upper piston 320. Similarly, one or more lower load pins 329 may extend radially through a load ring 331 (e.g., annular load ring), coupling the load ring 331 to the lower piston 318. As the lower piston 318 moves back and forth in the axial direction 152, the load ring 331 moves axially with the lower piston 318.

The running tool assembly 300 includes first and second pressure ports 330, 332. The first pressure port 330 may be in fluid communication with a volume of air that acts on the top surface 334 of the lower piston 318, such that when the volume of air is pressurized via the first pressure port 330, the pressure acts on the lower piston 318. The second pressure port may be in fluid communication with a volume of air that acts on the upper piston 320, such that when the volume of air is pressurized via the second pressure port 332, the pressure acts on the upper piston 320.

As illustrated in FIG. 4, the running tool assembly 300 may include an insertion tool 336 coupled to the axial 152 end of the body 302 adjacent to the lower retainer seal ring 312. As will be discussed with regard to FIG. 5, the insertion tool 336 may be used to couple the seal assembly 150 of FIG. 3 to the running tool assembly 300. The insertion tool 336 may include a flange 338 at an axial end 339 of the insertion tool 336. As illustrated in FIG. 4, the insertion tool 336 may be inserted into the body 302 such that the flange 338 is adjacent to, and in some cases abuts, the flange 316 of the lower retainer seal ring 312. The flange 338 may include an O-ring 340 on a radially 154 exterior surface of the insertion tool 336 that forms a seal between the flange 338 and the body 302. Below the flange 338, the insertion tool 336 may include an annular recess 342, which may receive dowel pins 344 from the body 302. The dowel pins 344 may be used to prevent relative axial 152 movement between the body 302 and the insertion tool 336. In some instances, the dowel pins 344 may also be used to prevent rotation of the insertion tool 336 relative to the body 302.

As shown in FIG. 4, the insertion tool 336 may also include a plurality of upper and lower spring-loaded anti-rotation pins 346, 348, which couple the seal assembly 150 (see FIG. 3) to the running tool assembly 300 (e.g., via the insertion tool 336), and may prevent rotation of the seal assembly 150 (see FIG. 3) relative to the insertion tool 336 when the seal assembly 150 is coupled to the running tool assembly 300. The upper and lower anti-rotation pins 346, 348 are situated pointing radially outward from the insertion tool 336 and may be configured to radially 154 extend or contract in order to hold or release the seal assembly 150 (see FIG. 3).

Figure 5:
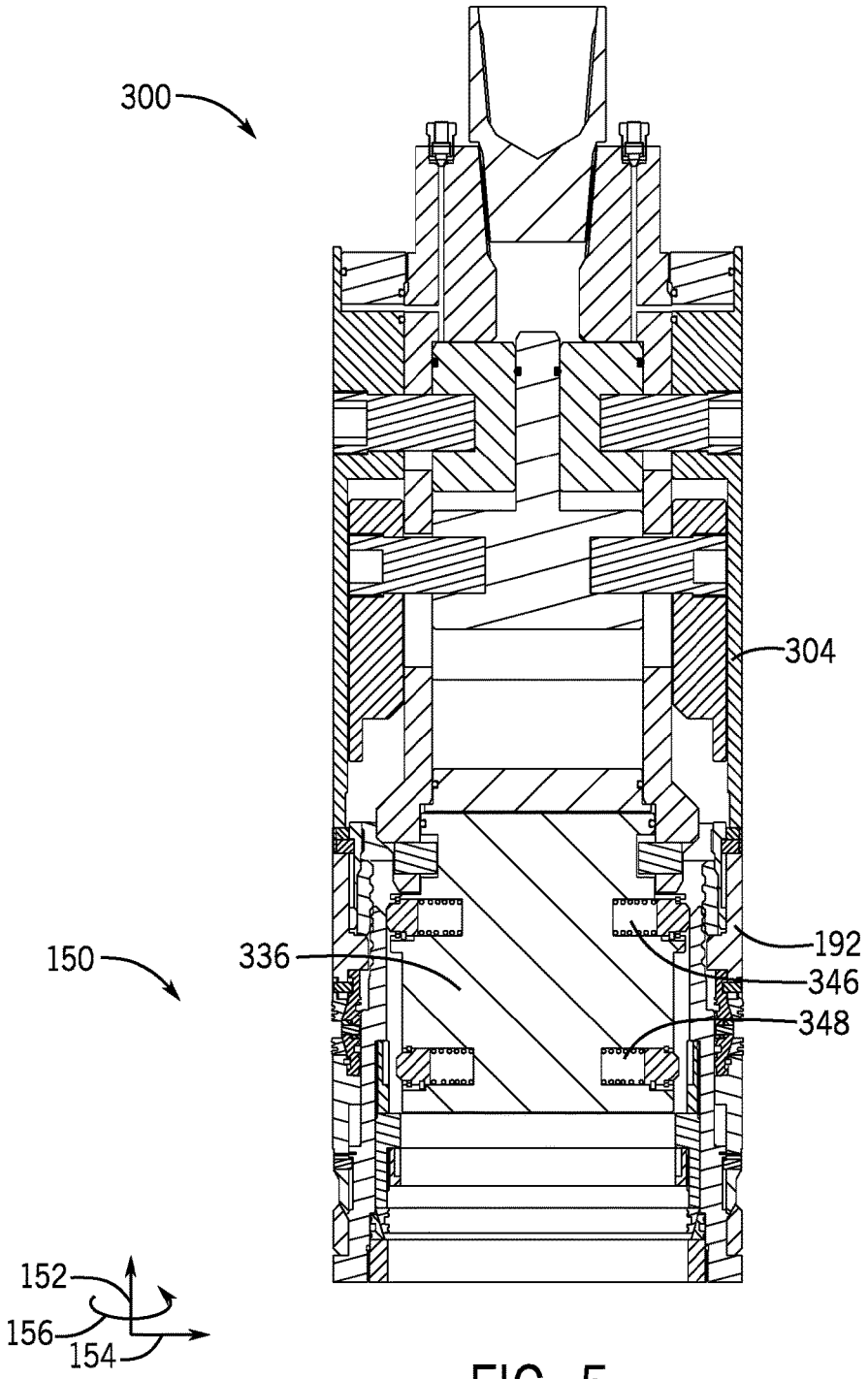
FIG. 5 is a side, section view of an embodiment of the seal assembly of FIG. 3 coupled to the running tool assembly of FIG. 4.

FIG. 5 is a side, section view of the seal assembly 150 coupled to the running tool assembly 300. As illustrated, the insertion tool 336 of the running tool assembly 300 is inserted into the seal assembly 150 such that the load ring 192 of the seal assembly 150 abuts the sleeve 304 of the running tool assembly 300. The upper and lower anti-rotation pins 346, 348 extend radially outward 154, coupling the seal assembly 150 to the running tool assembly 300.

Figure 6:
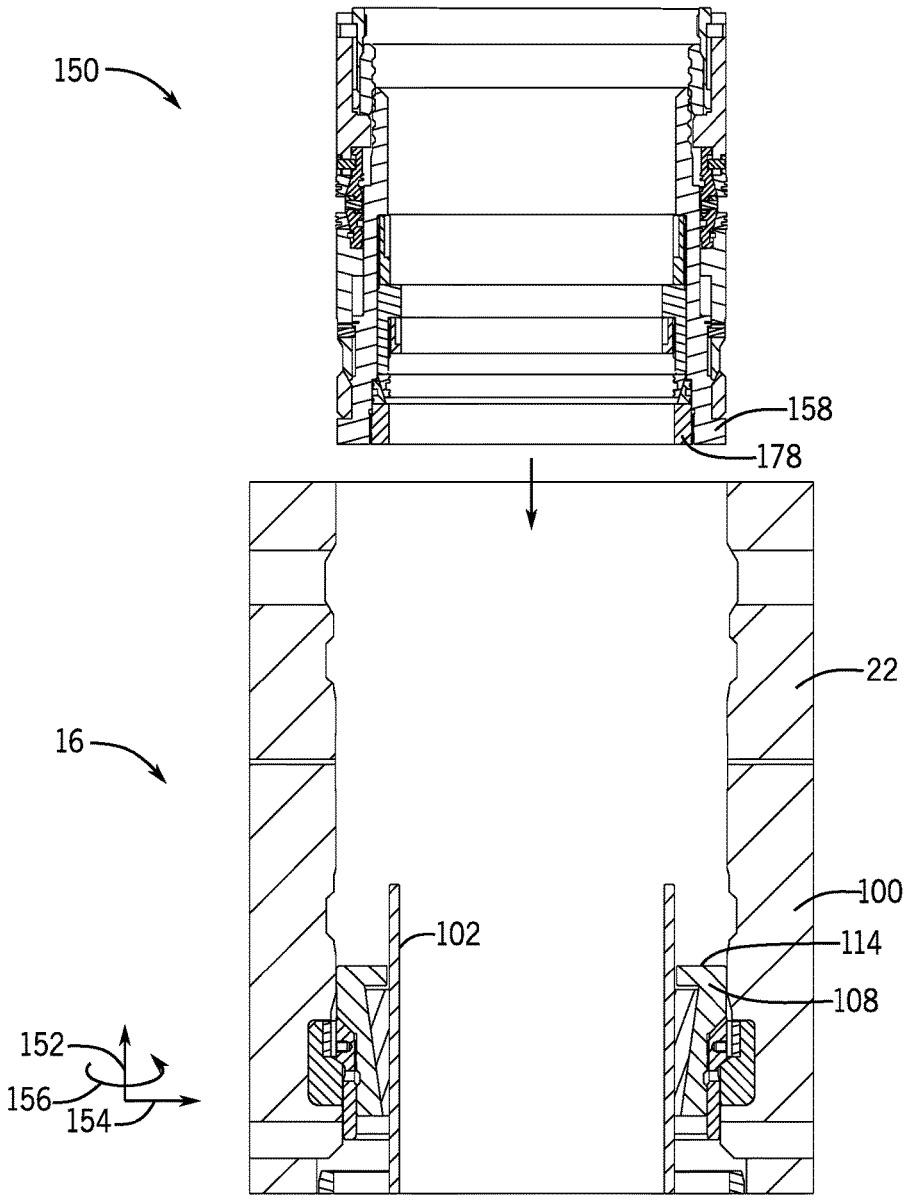
FIG. 6 is a side, section view of an embodiment of the seal assembly of FIGS. 3 and 4 being inserted into the well of FIG. 2.

FIG. 6 is a side, section view of the seal assembly 150 being inserted into the well 16 via the running tool assembly 300. In the illustrated embodiment, the seal assembly 150 is inserted in the axial direction 152 into the well 16, through the casing spool 22 and into the housing 100 until the body 158 and/or the threaded ring 178 land on the top surface 114 of the slip bowl 108 (see FIG. 7). However, it should be appreciated that the seal assembly 150 may be installed at any location within the well 16 and that FIG. 6 illustrates just one of many envisaged locations for the seal assembly 150.

Figure 7:
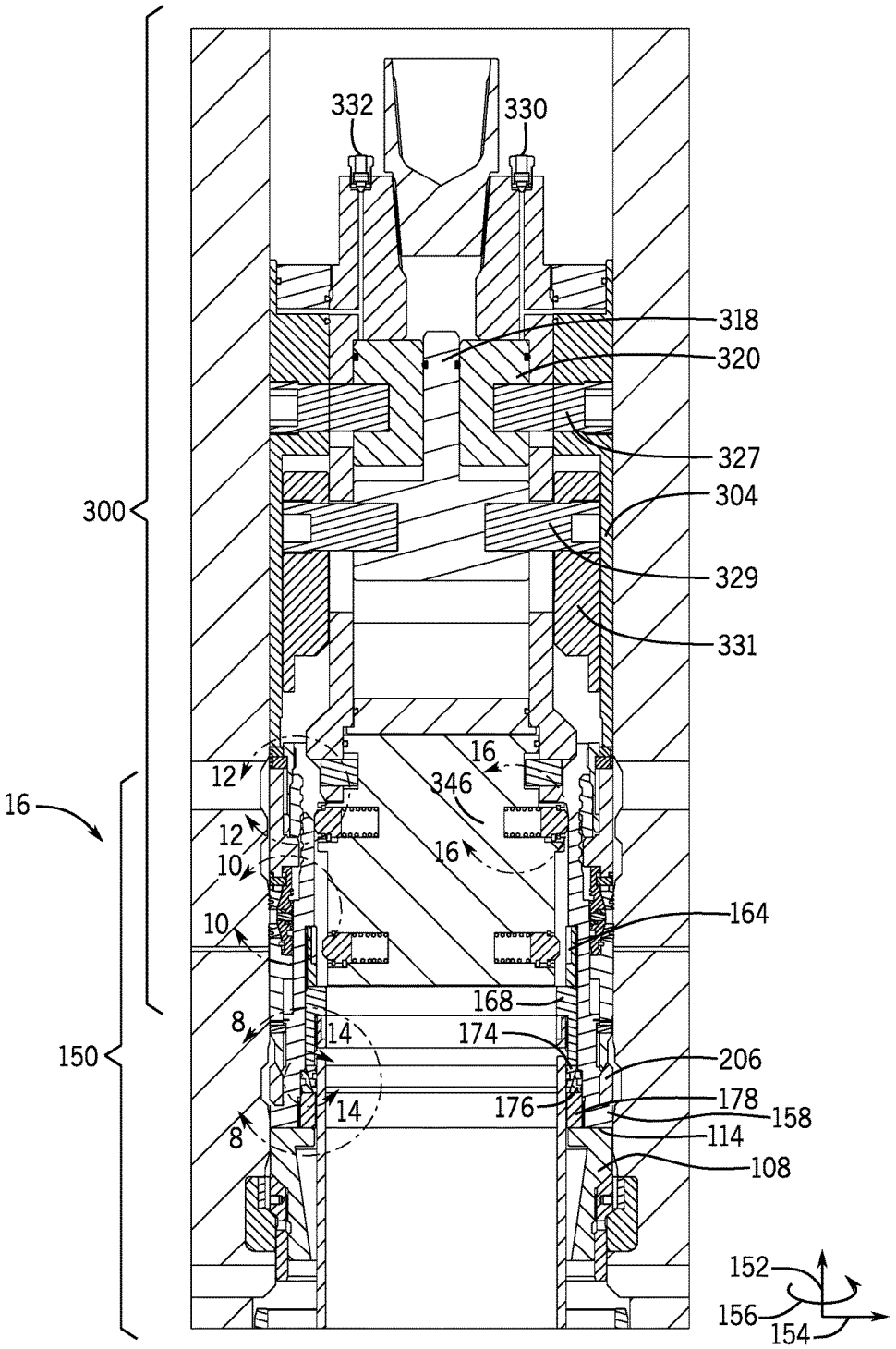
FIG. 7 is a side, section view of an embodiment of the seal assembly and the running tool assembly inserted in the well.

FIG. 7 is a side, section view of the seal assembly 150 and the running tool assembly 300 inserted in the well 16. As shown, the seal assembly 150, which is coupled to the running tool assembly 300 has been inserted into the well until the body 158 and/or the threaded ring 178 lands on the top surface 114 of the slip bowl 108. Once the seal assembly 150 lands on the top surface 114 of the slip bowl 108, a force is applied to the seal assembly 150 via the running tool assembly 300 in order to set the lock ring 206.

Figure 8:
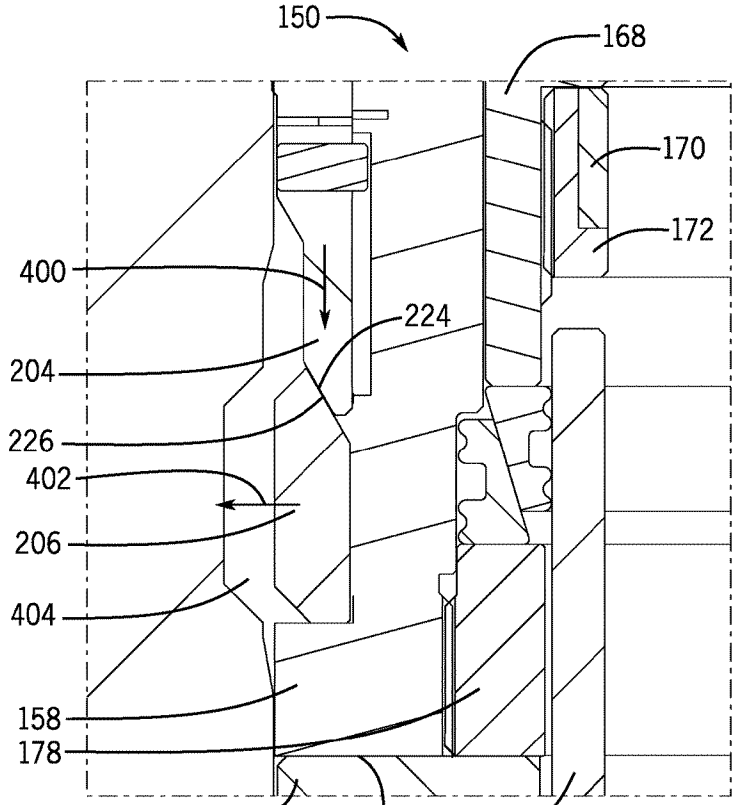
FIG. 8 is a side, section, detail view of an embodiment of a bottom lock ring and an embodiment of a bottom push ring before the bottom lock ring has been set.

FIG. 8 is a side, section, detail view of the bottom lock ring 206 and bottom push ring 204 taken within line 8-8 of FIG. 7 illustrating the assembly before the bottom lock ring 206 has been set. As shown, the bottom lock ring 206 is adjacent to the body 158 in the radial direction 154. When the bottom lock ring 206 is not set, the inward tapered interior surface 226 of the bottom lock ring 206 is in contact with the inward tapered exterior surface 224 of the bottom push ring 204. A force in the axial direction 152 is applied to the seal assembly 150 via the running tool assembly 300, pushing the bottom push ring 204 in the axial direction 152, as indicated by arrow 400. As the bottom push ring 204 moves in the axial direction 152, the inward tapered exterior surface 224 of the bottom push ring 204 interfaces with the inward tapered interior surface 226 of the bottom lock ring 206, pushing the bottom lock ring 206 radially outward 154 (as indicated by arrow 402) into an annular recess 404.

Figure 9:
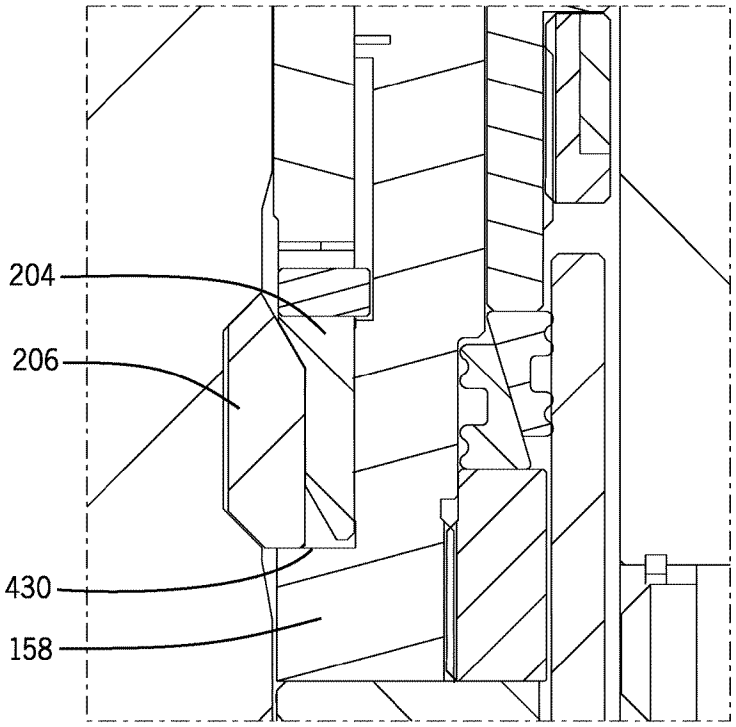
FIG. 9 is a side, section, detail view of an embodiment of the bottom lock ring in a set position.

FIG. 9 is a side, section, detail view of the bottom lock ring 206 of FIG. 8 in the set position. As illustrated, the bottom push ring 204 has moved axially 152 downward such that the bottom push ring 204 lands on or approaches the body 158, the bottom push ring 204 is disposed radially between the body 158 and the bottom lock ring 206, and the bottom lock ring 206 fills the annular recess 404 (see FIG. 8), restricting axial 152 movement of the seal assembly 150. Furthermore, in the set position, both the bottom lock ring 206 and the bottom push ring 204 rest on an annular surface 430 of the body 158. After the bottom lock ring 206 is set, the outside seal may be set.

Figure 10:
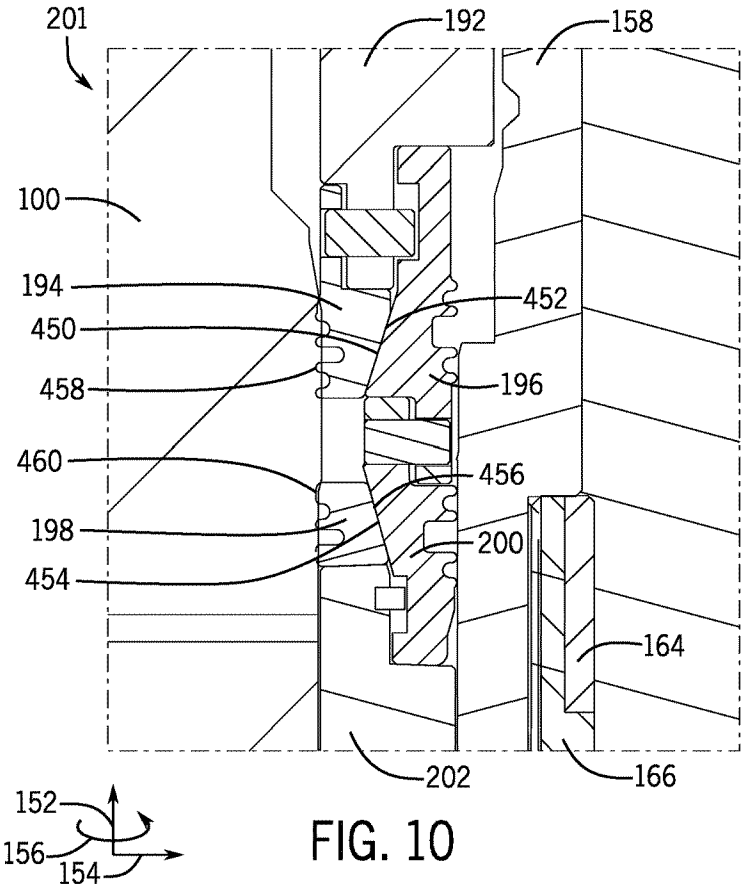
FIG. 10 is a side, section, detail view of part of an embodiment of an outside sealing assembly before the outside seal has been set.

FIG. 10 is a side, section, detail view of part of the exterior sealing assembly 201 taken within line 10-10, illustrating the assembly before the outside seal has been set. As shown and discussed with regard to FIG. 3, the top outer seal 194 and bottom outer seal 198 are disposed about (i.e., radially 154 outward from) the top inner seal 196 and the bottom inner seal 200, respectively. As illustrated in FIG. 10, the top outer seal 194 has an outward tapered interior surface 450 (e.g., tapered annular surface or conical surface), which interfaces with a corresponding outward tapered exterior surface 452 (e.g., tapered annular surface or conical surface) of the top inner seal 196, such that as the top outer seal 194 moves axially 152 downward, the top outer seal 194 also moves radially 154 outward. Correspondingly, as the top outer seal 194 moves axially 152 upward, the top outer seal 194 also moves radially 154 inward. Similarly, the bottom outer seal 198 has an inward tapered interior surface 454 (e.g., tapered annular surface or conical surface), which interfaces with a corresponding inward tapered exterior surface 456 (e.g., tapered annular surface or conical surface) of the bottom inner seal 200, such that as the bottom outer seal 198 moves axially 152 upward, the bottom outer seal 198 moves radially 154 outward. Correspondingly, as the bottom outer seal 198 moves axially 152 downward, the bottom outer seal 198 also moves radially 154 inward. The radially 154 exterior surfaces 458, 460 of the top outer seal 194 and the bottom outer seal 198, respectively, may include sealing features (e.g., an O-ring) to form seals with the housing 100, the casing spool 22, or some other component of the well (see FIG. 2). In the illustrated embodiment, the top outer seal 194 and the bottom outer seal 198 are indirectly coupled to the lower piston 318 (e.g., via the lower load pin 329 and the load ring 331, as shown in FIG. 7) such that when a pressure is applied via the first pressure port 330, the lower piston 318 and the load ring move axially 152 downward, causing the top outer seal 194 and the bottom outer seal 198 to move relative to the top inner seal 196 and the bottom inner seal 200. As the top outer seal 194 and the bottom outer seal 198 move toward one another, the top outer seal 194 and the bottom outer seal 198 move radially 154 outward as a result of the tapered surfaces 450, 452, 454, 456, forming a seal with the housing 100.

Figure 11:
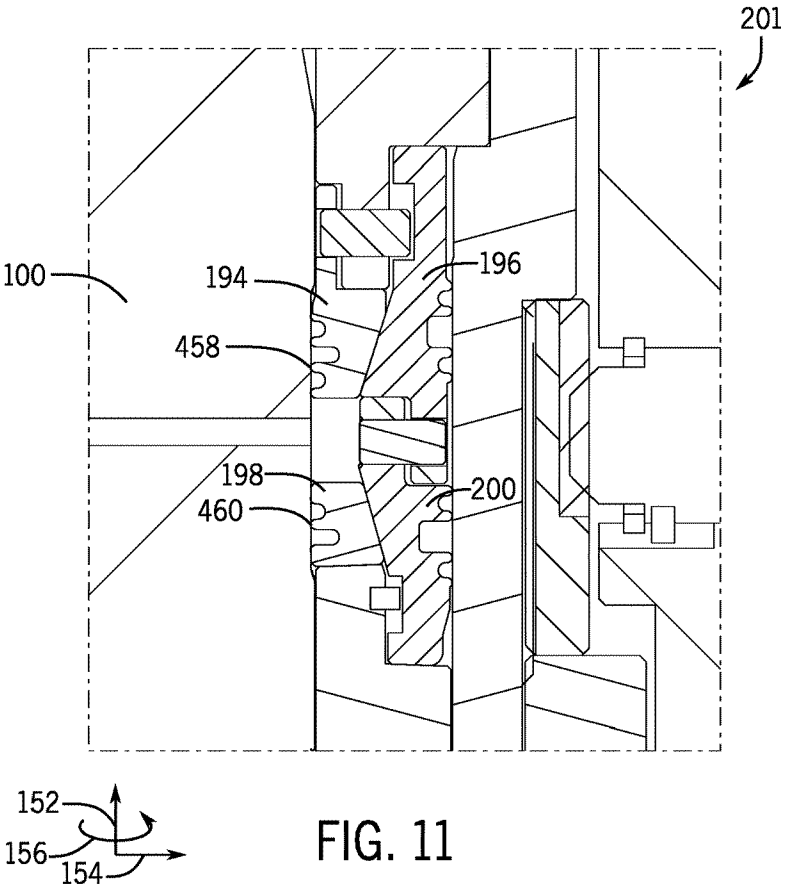
FIG. 11 is a side, section, detail view of part of the outside sealing assembly of FIG. 10 after the outside seal has been set.

FIG. 11 is a side, section, detail view of part of the outside sealing assembly 162 after the outside seal has been set. As illustrated in FIG. 11, the top outer seal 194 is pushed radially outward by the top inner seal 196 such that the exterior surface 458 of the top outer seal 194 forms a seal with the housing 100. Similarly, the bottom outer seal 198 is pushed radially outward by the bottom inner seal 200 such that the exterior surface 460 of the bottom outer seal 198 forms a seal with the housing 100. After the outside seal has been set, the top lock ring may be set.

Figure 12:
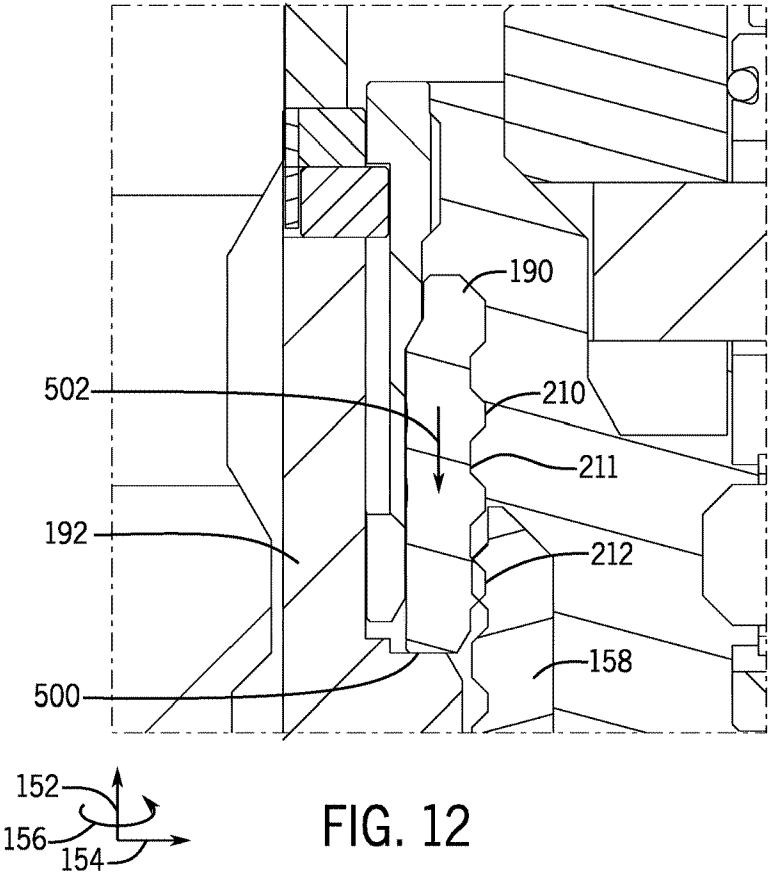
FIG. 12 is a side, section, detail view of an embodiment of a top lock ring and a body before the top lock ring has been set.

FIG. 12 is a side, section, detail view of the top lock ring 190 and body 158 taken within line 12-12 of FIG. 7, illustrating the assembly before the top lock ring 190 has been set. As shown, the top lock ring 190 rests on top of an annular surface 500 of the load ring 192 and may be in contact with the body 158 in the radial direction 154, but the teeth 210 of the top lock ring 190 will not be aligned with, or engaged with, the teeth 212 of the body 158. As pressure is applied via the first pressure port 330, the lower piston 318 continues to move axially 152 downward (see FIG. 3). As the lower piston 318 and the load ring 331 continues to move axially 152 downward, biasing the top lock ring 190 and the load ring 192 axially 152 downward (indicated by arrow 502) until the teeth 210 on the radially 154 interior surface 211 of the top lock ring 190 align with and interface with the teeth 212 of the body 158.

Figure 13:
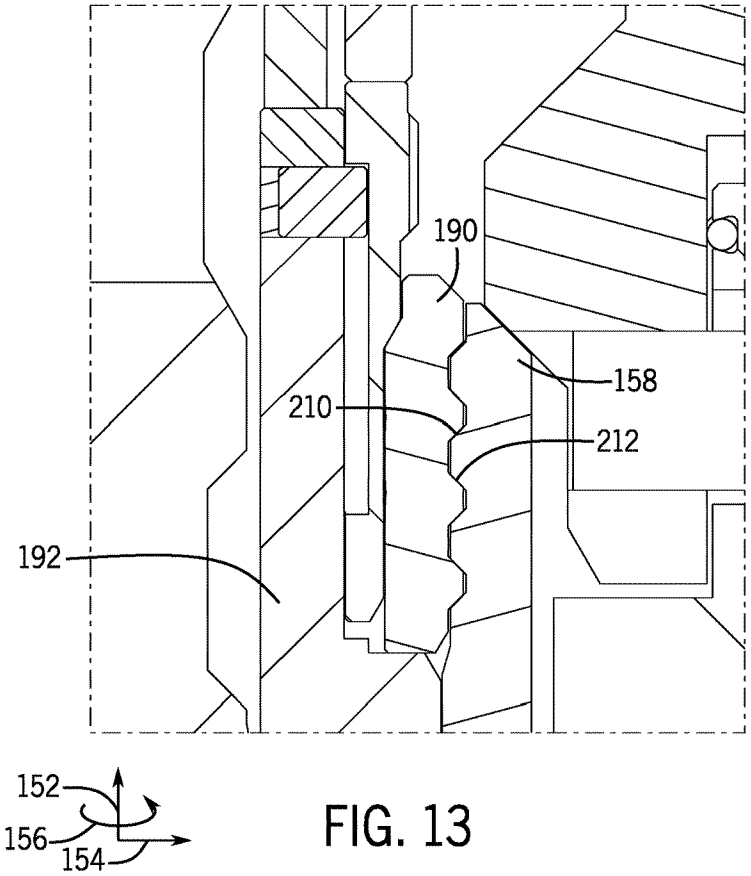
FIG. 13 is a side, section, detail view of the top lock ring of FIG. 12 in a set position.

FIG. 13 is a side, section, detail view of the top lock ring 190 of FIG. 12 in the set position. As illustrated, the top lock ring 190 has moved axially 152 downward (e.g., along arrow 502 shown in FIG. 12) until the teeth 210 on the radially 154 interior surface of the top lock ring 190 align with and interface with the teeth 212 of the body 158.

Figure 14:
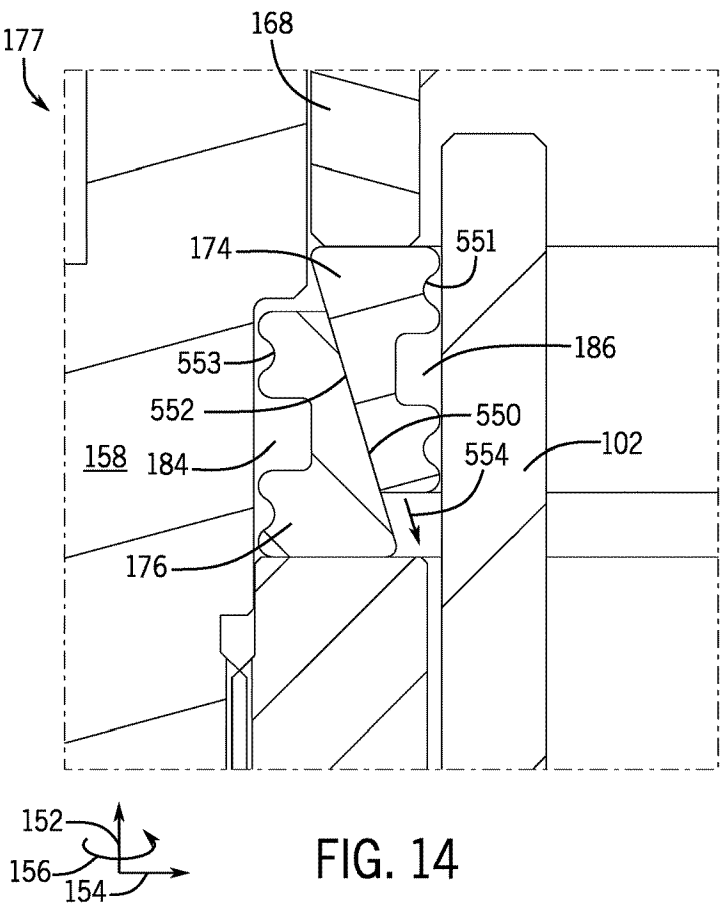
FIG. 14 is a side, section, detail view of an embodiment of a casing seal and a body seal before an inside seal has been set.

After the top lock ring 190 is set, the inside seal (e.g., the interior sealing assembly 177) may be set. When a pressure is applied to the second pressure port 332 (see FIG. 7), the upper piston 320 and the sleeve 304 move axially 152 downward, biasing the push ring 168 downward on the casing seal 174. FIG. 14 is a side, section, detail view of the interior sealing assembly 177 (e.g., the casing seal 174 and the body seal 176) taken within line 14-14 of FIG. 7, illustrating the assembly before the interior sealing assembly 177 has been set. As shown and described with regard to FIG. 3, the casing seal 174 is annular in shape with the inward tapered exterior surface 550. The casing seal 174 also includes the annular seal 186 on the interior surface 551 of the casing seal 174. The body seal 176 is annular in shape with the inward tapered interior surface 552. The body seal 176 also includes the annular seal 184 on the exterior surface 553 of the body seal 176. As the casing seal 174 moves radially downward (e.g., pushed by the push ring 168, indicated by arrow 554), the tapered exterior surface 550 of the casing seal 174 interfaces with the tapered interior surface 552 of the body seal 176 such that the casing seal 174 is pushed radially 154 inward and the body seal 176 is pushed radially 154 outward. The casing seal 174 being pushed radially 154 inward forms a seal between the annular seal 186 and the casing 102. Similarly, the body seal 176 being pushed radially 154 outward forms a seal between the annular seal 184 and the body 158.

Figure 15:
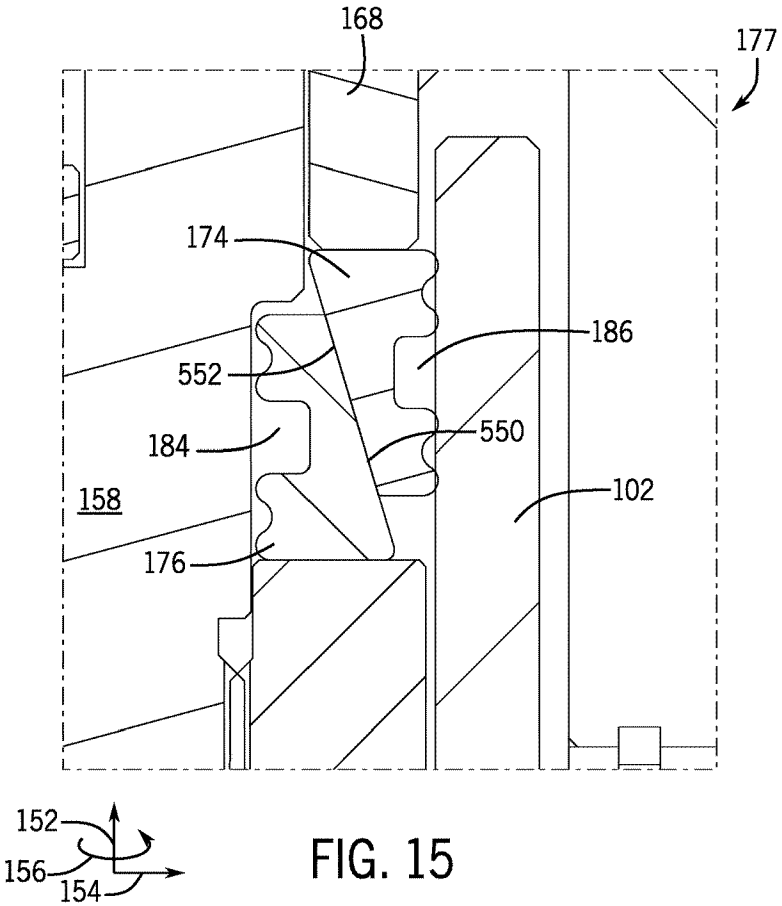
FIG. 15 is a side, section, detail view of the casing seal and the body seal after the inside seal has been set.

FIG. 15 is a side, section, detail view of the interior sealing assembly 177 (e.g., the casing seal 174 and the body seal 176) of FIG. 14 after the inside seal (e.g., interior sealing assembly 177) has been set. As illustrated, the casing seal 174 forms a seal with the casing 102 via the annular seal 186. Similarly, the body seal 176 forms a seal with the body 158 via the annular seal 184. The tapered exterior surface 550 and the tapered interior surface 552 interface with one another to push the casing seal 174 radially 154 inward and the body seal 176 radially 154 outward, in order to keep the respective seals (i.e., the seal between the casing seal 174 and the casing 102, and the seal between the body seal 176 and the body 158) tight.

Figure 16:
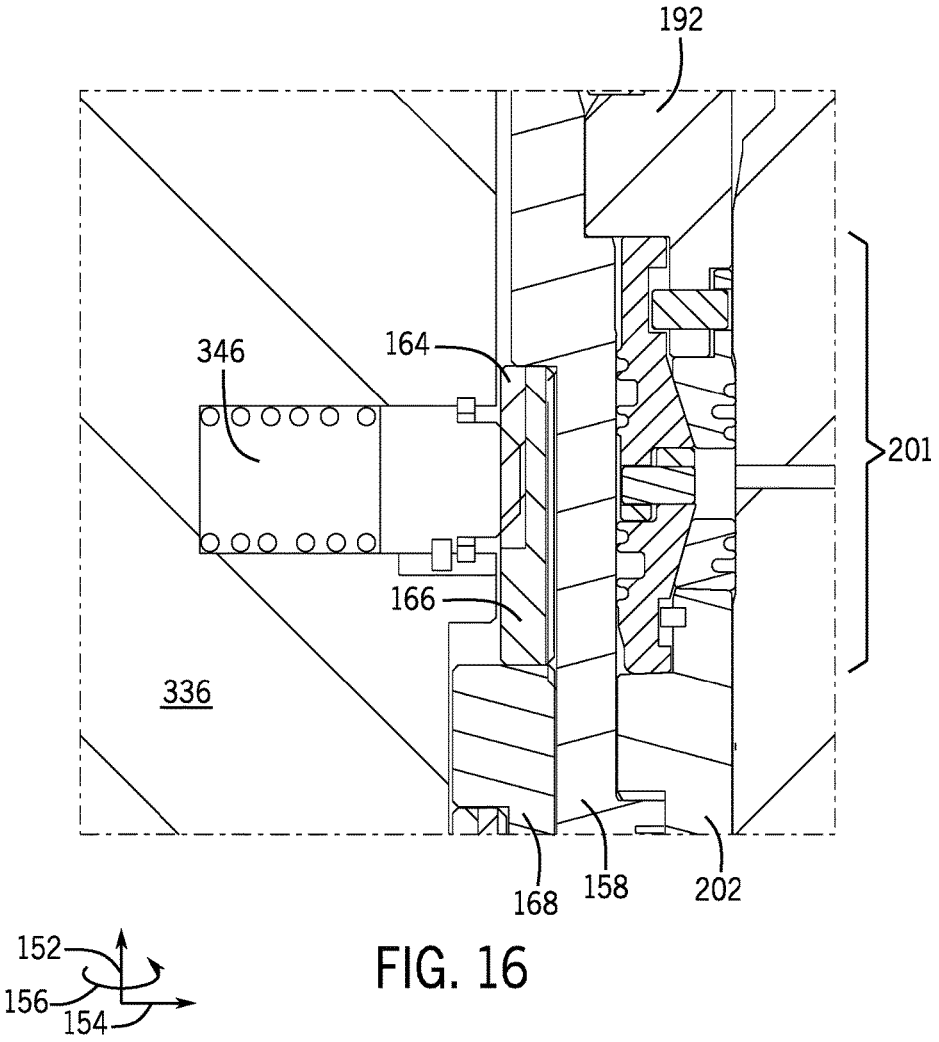
FIG. 16 is a side, section, detail view of an embodiment of an upper anti-rotation pin extending radially outward toward, and making contact with, an upper preload ring.

Once the inside seal has been set, the upper preload ring 164 (see FIGS. 3 and 7) may be preloaded. The upper anti-rotation pin 346 may be radially extended to press against the upper preload ring 164 and the running tool assembly 300 may be rotated to preload the upper preload ring 164. FIG. 16 is a side, section, detail view taken within line 16-16 of FIG. 7, illustrating the upper anti-rotation pin 346 extending radially 154 outward toward, and making contact with, the upper preload ring 164. Once the upper anti-rotation pin 346 presses against the upper preload ring 164, the insertion tool 336 is rotated in the circumferential direction 156, thus axially 152 preloading (e.g., via a threaded engagement) the upper preload ring 164. The insertion tool 336 may then be moved axially 152 upward in order to axially 152 preload the lower preload ring 170.

Figure 17:
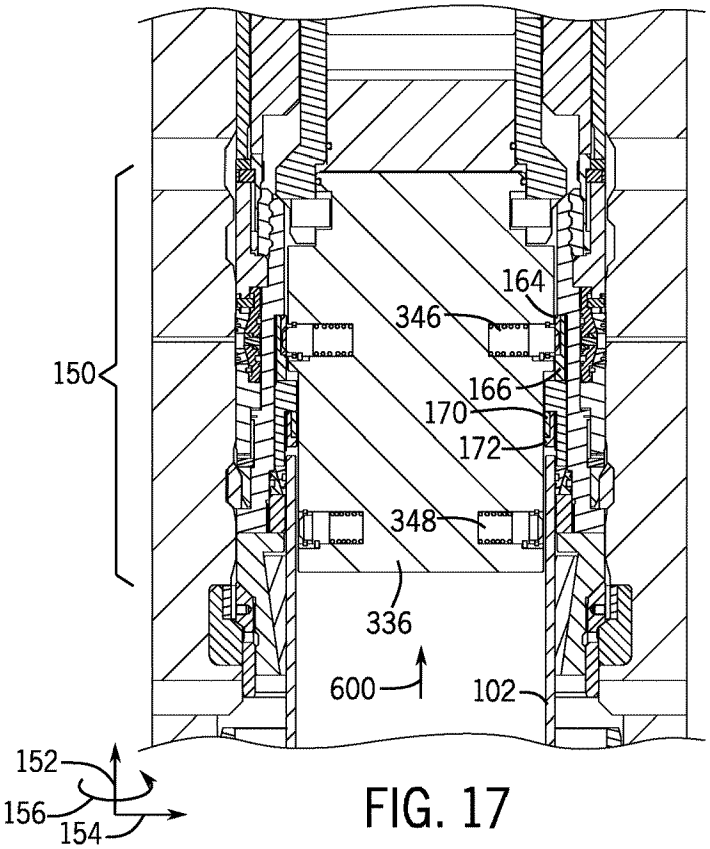
FIG. 17 is a side, section view of an embodiment of the insertion tool at a position such that the upper anti-rotation pin engages with an upper preload ring.

FIG. 17 is a side, section view of the insertion tool 336 at a position such that the upper anti-rotation pin 346 engages with the upper preload ring 164. Once the upper preload ring 164 has been preloaded, the upper anti-rotation pin 346 may retract radially 154 inward and the insertion tool 336 may retract the seal assembly 150 axially 152 (e.g., as indicated by arrow 600) until the lower anti-rotation pins 348 align with the lower preload ring 170.

Figure 18:
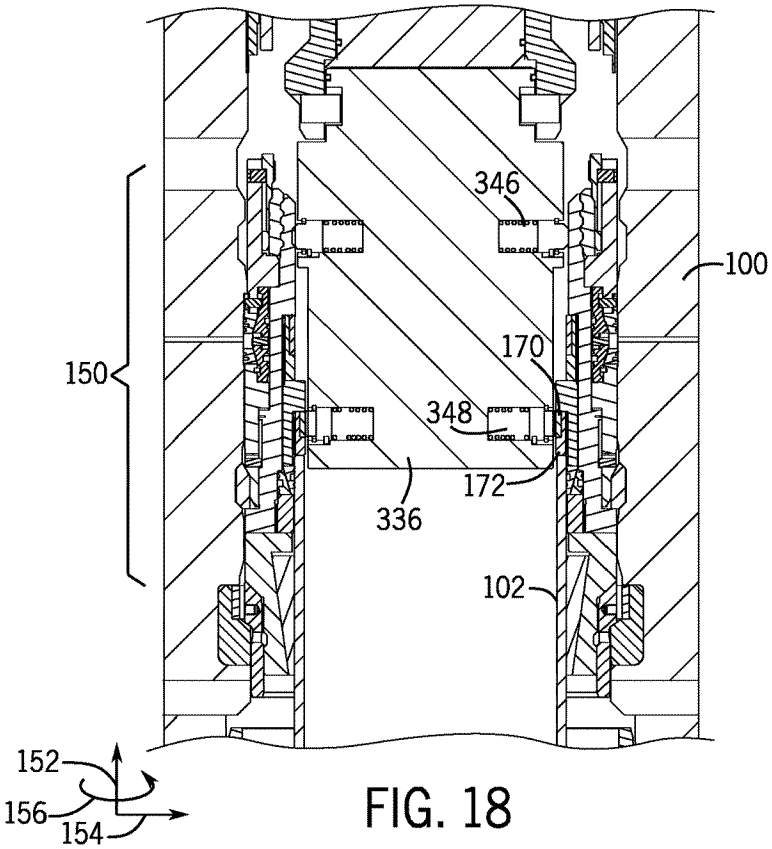
FIG. 18 is a side, section view of an embodiment of the insertion tool retracted axially until one or more lower anti-rotation pins align with a lower preload ring.

FIG. 18 is a side, section view of the insertion tool 336 retracted axially 152 until the lower anti-rotation pins 348 align with the lower preload ring 170. As shown, once the lower anti-rotation pins 348 are aligned with the lower preload ring 170, the lower anti-rotation pins 348 extend radially outward toward, and make contact with, the lower preload ring 170. The running tool assembly 300 and insertion tool 336 may then be rotated (e.g., in the circumferential direction 156) along with the lower preload ring 170 in order to axially 152 preload (e.g., via a threaded engagement) the lower preload ring 170. The lower anti-rotation pins 348 may then retract radially 154 inward and the running tool assembly (and the insertion tool 336) removed from the well 16.

Figure 19:
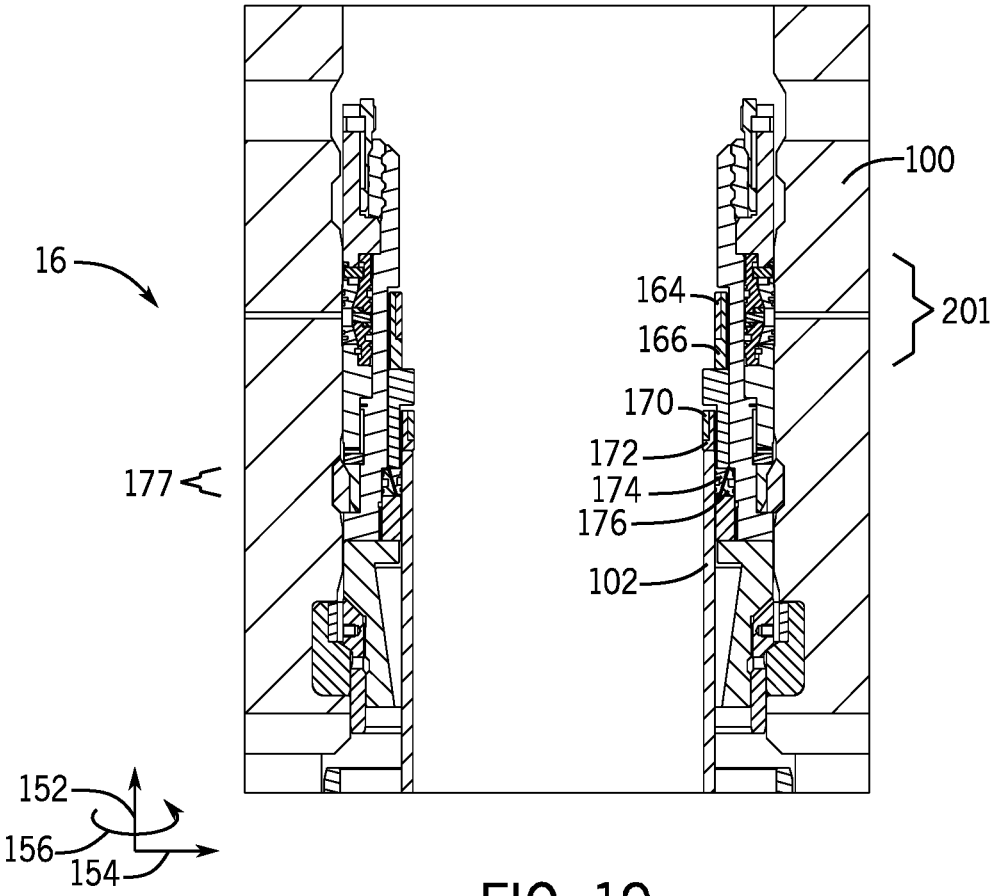
FIG. 19 is a side, section view of an embodiment of the seal assembly installed in the well, with the running tool assembly and the insertion tool removed.

FIG. 19 is a side, section view of the seal assembly 150 installed in the well 16, with the running tool assembly 300 and the insertion tool 336 removed. The seal assembly forms a seal between a first fixed tubular member (e.g., casing 102) and a second fixed tubular member (e.g., housing 100), disposed about the first tubular member. The preloaded upper preload ring 164 and lower preload ring 170 restrict axial 152 movement of the hold down ring 166 and the casing lock down ring 172, respectively, thus restricting axial 152 movement of the seal assembly 150. The exterior sealing assembly 201 inhibits fluid flow between the seal assembly 150 and the housing 100 (or other component along the exterior of the well, such as the casing spool 22). Similarly, the interior sealing assembly 177 inhibits fluid flow between the casing 102 and the seal assembly 150. Accordingly, the exterior sealing assembly 201 and the interior sealing assembly 177 work in conjunction to inhibit fluid flow between the casing 102 and the housing 100 (or other component along the exterior of the well, such as the casing spool 22). Because of their size and how they are actuated, the running tool assembly 300 and seal assembly 150 may be run through the BOP and the seal assembly 150 installed with a single trip from the running tool assembly 300, thus reducing the time, number of steps, and complexity to seal a well 16.

While the disclosed subject matter may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The invention claimed is:

1. A system, comprising:

a seal assembly, comprising:

an annular body;

an interior sealing assembly, actuated by a first piston, and coupled to an interior surface of the annular body and configured to form a seal between the annular body and a first fixed substantially tubular member disposed radially interior of the annular body, wherein the interior sealing assembly comprises:

an annular body seal ring disposed radially interior of the annular body and having an inward tapered interior surface;

an annular casing seal ring disposed radially interior of the annular body seal ring and having an inward tapered exterior surface, wherein the tapered exterior surface and tapered interior surface interface with one another such that as the annular casing seal ring and the annular body seal ring move toward one another in an axial direction, the annular casing seal ring is pushed radially inward and the annular body seal ring is pushed radially outward; and an annular push ring disposed radially interior of the annular body, wherein an annular bottom surface of the annular push ring abuts an annular top surface of the annular casing seal ring, and wherein the annular push ring, in operation, pushes the annular casing seal ring in the axial direction toward the annular body seal ring, such that the annular casing seal ring moves in the axial direction;

an exterior sealing assembly, actuated by a second piston, and coupled to an exterior surface of the annular body and configured to form a seal between the annular body and a second fixed substantially tubular member disposed about the seal assembly;

wherein the seal assembly is configured to be run through a blowout preventer (BOP) stack and installed between the first and second fixed substantially tubular members to seal a mineral extraction well.

2. The system of claim 1, wherein the exterior sealing assembly comprises:

an annular top inner seal disposed about the annular body and having an outward tapered exterior surface;

an annular top outer seal disposed about the annular top inner seal and having an outward tapered interior surface, wherein the outward tapered exterior surface and outward tapered interior surface interface with one another such that as the annular top outer seal moves axially downward, the annular top outer seal is pushed radially outward;

an annular bottom inner seal disposed about the annular body and axially adjacent to the annular top inner seal, the annular bottom inner seal having an inward tapered exterior surface; and an annular bottom outer seal disposed about the annular bottom inner seal and having an inward tapered interior surface, wherein the inward tapered exterior surface and inward tapered interior surface interface with one another such that as the annular bottom outer seal moves axially upward, the annular bottom outer seal is pushed radially outward.

3. The system of claim 1, comprising:

an annular lower preload ring disposed radially interior of the annular push ring; and an annular casing lockdown ring disposed about the annular lower preload ring, wherein an annular bottom surface of a lip of the annular push ring rests on top of an annular top surface of the annular lower preload ring and an annular top surface of the annular casing lockdown ring to resist downward axial movement of the annular push ring.

4. The system of claim 3, comprising:

an annular upper preload ring disposed radially interior of the annular body; and an annular hold down ring disposed about the upper preload ring, wherein an annular bottom surface of the annular hold down ring abuts an annular top surface of the annular push ring to resist upward axial movement of the annular push ring.

5. The seal assembly of claim 1, comprising an annular bottom lock ring configured to expand in a radial direction to couple the seal assembly to the second fixed substantially tubular member disposed about the seal assembly.

6. The seal assembly of claim 1, comprising:

a tool assembly, comprising a cylindrical seal insertion tool, configured to be inserted into, and couple to the seal assembly;

the first piston coupled to the cylindrical seal insertion tool and having a cylindrical protrusion;

the second piston having an annular shape and disposed about the cylindrical protrusion of the first piston;

a first pressure port in fluid communication with a first volume in contact with the first piston;

a second pressure port in fluid communication with a second volume in contact with the second piston;

wherein applying a first pressure to the first pressure port actuates the exterior sealing assembly to form the seal between the annular body and the second fixed substantially tubular member, and wherein applying a second pressure to the second pressure port actuates the interior sealing assembly to form the seal between the annular body and the first fixed substantially tubular member.

7. A system comprising:

a seal assembly, comprising:

an annular body;

an interior sealing assembly disposed radially interior of the annular body and configured to form a seal between the annular body and a first fixed substantially tubular member;

an exterior sealing assembly coupled to an exterior surface of the annular body and configured to form a seal between the annular body and a second fixed substantially tubular member;

a tool assembly, comprising a cylindrical seal insertion tool, configured to be inserted into, and couple to the seal assembly;

a first piston coupled to the cylindrical seal insertion tool and having a cylindrical protrusion;

a second piston having an annular shape and disposed about the cylindrical protrusion of the first piston;

a first pressure port in fluid communication with a first volume in contact with the first piston;

a second pressure port in fluid communication with a second volume in contact with the second piston;

wherein applying a first pressure to the first pressure port actuates the exterior sealing assembly to form the seal between the annular body and the second fixed substantially tubular member, and wherein applying a second pressure to the second pressure port actuates the interior sealing assembly to form the seal between the annular body and the first fixed substantially tubular member.

8. The system of claim 7, wherein the exterior sealing assembly comprises:

an annular top inner seal disposed about the annular body and having an outward tapered exterior surface;

an annular top outer seal disposed about the annular top inner seal and having an outward tapered interior surface, wherein the outward tapered exterior surface and outward tapered interior surface interface with one another such that as the annular top outer seal moves axially downward, the annular top outer seal is pushed radially outward;

an annular bottom inner seal disposed about the annular body and axially adjacent to the annular top inner seal, the annular bottom inner seal having an inward tapered exterior surface; and an annular bottom outer seal disposed about the annular bottom inner seal and having an inward tapered interior surface, wherein the inward tapered exterior surface and the inward tapered interior surface interface with one another such that as the annular bottom outer seal moves axially upward, the annular bottom outer seal is pushed radially outward.

9. The system of claim 7, wherein the interior sealing assembly comprises:

an annular body seal ring disposed radially interior of the annular body and having an inward tapered interior surface; and an annular casing seal ring disposed radially interior of the annular body seal ring and having an inward tapered exterior surface, wherein the inward tapered exterior surface and the inward tapered interior surface interface with one another such that as the annular casing seal ring and the annular body seal ring move toward one another in an axial direction, the annular casing seal ring is pushed radially inward and the body seal is pushed radially outward.

10. The system of claim 9, wherein the seal assembly comprises an annular push ring disposed radially interior of the annular body, wherein an annular bottom surface of the annular push ring abuts an annular top surface of the annular casing seal ring, and wherein the annular push ring, in operation, pushes the annular casing seal ring in the axial direction toward the annular body seal ring when a second pressure is applied to the second pressure port.

11. The system of claim 10, wherein the seal assembly comprises:

an annular lower preload ring disposed radially interior of the annular push ring; and an annular casing lockdown ring disposed about the annular lower preload ring, wherein an annular bottom surface of a lip of the annular push ring rests on top of an annular top surface of the annular lower preload ring and an annular top surface of the annular casing lockdown ring to resist downward axial movement of the annular push ring;

wherein the annular lower preload ring is actuated by extending one or more lower anti-rotation pins of the cylindrical seal insertion tool in a radial direction to couple the seal assembly to the tool assembly, and then rotating the seal assembly and the tool assembly.

12. The system of claim 11, wherein the seal assembly comprises:

an annular upper preload ring disposed radially interior of the annular body; and an annular hold down ring disposed about the upper preload ring, wherein an annular bottom surface of the annular hold down ring abuts an annular top surface of the annular push ring to resist upward axial movement of the annular push ring;

wherein the upper preload ring is actuated by extending one or more upper anti-rotation pins of the cylindrical seal insertion tool in the radial direction to couple the seal assembly to the tool assembly, and then rotating the seal assembly and the tool assembly.

13. The system of claim 11, wherein the seal assembly comprises:

an annular bottom lock ring configured to expand in a radial direction to couple the seal assembly to the second fixed substantially tubular member disposed about the seal assembly; and an annular bottom push ring having an inward tapered exterior surface configured to interface with an inward tapered interior surface of the annular bottom lock ring, such that as the annular bottom push ring moves axially downward, the annular bottom lock ring expands in the radial direction.

14. A method, comprising:

coupling a seal assembly to a tool, wherein the seal assembly comprises:

an annular body; and an interior sealing assembly disposed radially interior of the annular body;

inserting the tool and the seal assembly axially into a second fixed substantially tubular member of a well;

applying a first pressure via a first pressure port, moving a first piston, and sealing an exterior sealing assembly, wherein the exterior sealing assembly forms a first seal between the seal assembly and the second fixed substantially tubular member;

applying a second pressure via a second pressure port, moving a second piston, and sealing an interior sealing assembly, wherein the interior sealing assembly forms a second seal between the seal assembly and a first fixed substantially tubular member disposed radially interior of the seal assembly, wherein the interior sealing assembly comprises:

an annular body seal ring disposed radially interior of the annular body and having an inward tapered interior surface;

an annular casing seal ring disposed radially interior of the annular body seal ring and having an inward tapered exterior surface, wherein the inward tapered exterior surface and the inward tapered interior surface interface with one another such that as the annular casing seal ring and the annular body seal ring move toward one another in an axial direction, the annular casing seal ring is pushed radially inward and the annular body seal ring is pushed radially outward; and an annular push ring disposed radially interior of the annular body, wherein an annular bottom surface of the annular push ring abuts an annular top surface of the annular casing seal ring, and wherein the annular push ring, in operation, pushes the annular casing seal ring in the axial direction toward the annular body seal ring, such that the annular casing seal ring moves in the axial direction;

decoupling the seal assembly from the tool; and retrieving the tool from the well.

15. The method of claim 14, wherein the exterior sealing assembly comprises:

an annular top inner seal disposed about an annular body of the seal assembly, and having an outward tapered exterior surface;

an annular top outer seal disposed about the annular top inner seal and having an outward tapered interior surface, wherein the outward tapered exterior surface and the outward tapered interior surface interface with one another such that as the annular top outer seal moves axially downward, the annular top outer seal is pushed radially outward;

an annular bottom inner seal disposed about the annular body and axially adjacent to the annular top inner seal, the annular bottom inner seal having an inward tapered exterior surface; and an annular bottom outer seal disposed about the annular bottom inner seal and having an inward tapered interior surface, wherein the inward tapered exterior surface and the inward tapered interior surface interface with one another such that as the annular bottom outer seal moves axially upward, the annular bottom outer seal is pushed radially outward.

16. The method of claim 14, comprising setting an annular bottom lock ring disposed about the annular body by applying an axial downward force to an annular bottom push ring, wherein the bottom push ring comprises an inward tapered exterior surface that interface with an inward tapered interior surface of the annular bottom lock ring such that as the push ring moves axially downward, the annular bottom push ring pushes the annular bottom lock ring radially outward.

17. The method of claim 14, wherein applying the first pressure via the first pressure port sets an annular top lock ring, wherein an interior surface of the annular top lock ring comprises a first set of teeth that engage with a second set of teeth on an exterior surface of an annular body of the seal assembly.

* * * * *